US007361040B2

(12) United States Patent
Ito et al.

(10) Patent No.: US 7,361,040 B2
(45) Date of Patent: Apr. 22, 2008

(54) BASE WITH INTEGRATED HEATSINK FOR COMPACT FLUORESCENT LAMPS

(75) Inventors: Heinz W. Ito, Topsfield, MA (US); Robert Pai, Danvers, MA (US); Albert M. Cavallaro, Durham, NH (US); James A. Gotay, Lowell, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/804,247

(22) Filed: May 17, 2007

(65) Prior Publication Data

US 2007/0270030 A1 Nov. 22, 2007

Related U.S. Application Data

(60) Provisional application No. 60/801,158, filed on May 17, 2006.

(51) Int. Cl.
*H01R 33/02* (2006.01)
*H01R 33/08* (2006.01)

(52) U.S. Cl. ..... 439/232; 439/617

(58) Field of Classification Search ..... 439/232, 439/226, 230, 233, 234, 617; 362/218, 172, 362/437

See application file for complete search history.

(56) References Cited

U.S. PATENT DOCUMENTS

| | | | | | |
|---|---|---|---|---|---|
| 2,386,190 | A | * | 10/1945 | Betts | 439/617 |
| 2,683,257 | A | * | 7/1954 | Gasser-Steiner | 439/230 |
| 2,987,695 | A | * | 6/1961 | Jensen et al. | 439/551 |
| 2,991,576 | A | * | 7/1961 | Roper | 40/546 |
| 3,005,907 | A | * | 10/1961 | Dupree | 362/630 |
| 3,431,540 | A | * | 3/1969 | Shimer et al. | 439/487 |
| 4,568,854 | A | * | 2/1986 | Westlund et al. | 313/579 |
| 4,596,433 | A | | 6/1986 | Oesterheld et al. | 439/206 |
| 4,713,019 | A | | 12/1987 | Gaynor | 439/232 |
| 4,738,630 | A | | 4/1988 | Wittmann | 439/226 |
| 4,842,535 | A | * | 6/1989 | Velke et al. | 439/232 |
| 5,124,897 | A | * | 6/1992 | Kraus | 362/652 |

* cited by examiner

*Primary Examiner*—Hae Moon Hyeon
(74) *Attorney, Agent, or Firm*—Carlo S. Bessone

(57) ABSTRACT

A subassembly (10) for a lamp base, the subassembly (10) has an outer (12) housing having a circumferential wall (14) and a top (16) closing one end (18) of the outer housing (12); at least one lamp receiving aperture (20) in the top (16); and an inner housing (22) contiguous with an entire inside surface (24) of the outer housing (12), the outer housing (12) being a metallic material and the inner housing (22) comprising a plastic material.

7 Claims, 2 Drawing Sheets

BASE WITH INTEGRATED HEATSINK FOR COMPACT FLUORESCENT LAMPS

CROSS-REFERENCE TO RELATED APPLICATIONS

This application claims priority from Provisional Patent Application No. 60/801,158, filed May 17, 2006.

TECHNICAL FIELD

This invention relates to lamp bases and more particularly to lamp bases for compact fluorescent lamps. Still more particularly it relates to subassembly for bases for high wattage compact fluorescent lamps, for example, lamps requiring power inputs of >26 watts.

BACKGROUND ART

The base of compact fluorescent lamps generally comprises a hollow outer shell and a flange that is subsequently inserted into the hollow outer shell and sealed thereto. Receptacles for receiving a plurality of small fluorescent lamp tubes are provided at one side of the shell and socket connecting means, usually projecting from the flange, are provided at the opposite side. The internal space between the outer shell and the flange may or may not contain the ballast circuitry needed for operation. Originally, the outer shells of compact fluorescent lamps not having internal ballast circuitry were made of metal; however, such shells were susceptible to generating electric shocks. To reduce the electrical shocking problem the industry turned to making the hollow shell of a high temperature plastic material. More recently, lamp operating temperatures have increased due to the use of higher wattage lamps in multi-lamp fixtures. In certain case lamps were found to develop cracks in the plastic shell after extended operating time. This cracking has an adverse effect on the sealing (locking) of the flange to the shell, thereby increasing the possibility of electrical shock on lamp removal. Additionally, the plastic shells were found to change color after extended periods of use, this color change having an adverse effect on the light output, especially when the lamp was mounted in a confining fixture.

DISCLOSURE OF INVENTION

It is, therefore, an object of the invention to obviate the disadvantages of the prior art.

It is another object of the invention to enhance fluorescent lamps.

It is yet another object of the invention to enhance compact fluorescent lamps.

These and other objects are achieved, in one aspect of the invention, by the provision of a subassembly for a base for a lamp, said subassembly comprising: an outer housing having a circumferential wall and a top closing one end of said outer housing; at least one lamp receiving aperture in said top; and an inner housing contiguous with the entire inside surface of said outer housing, said outer housing being a metallic material and said inner housing comprising a plastic material.

The metal/plastic composite subassembly provides improved bonding of the ballast component-carrying flange to the inner shell, primarily because the mechanical properties of the metal shell do not allow the plastic portion to distort or crack and separate, as occurs when the metal shell of the subassembly is not present.

Additionally, it has been found that the presence of the metal shell lowers the ignition voltage. Further, its presence reduces or eliminates the emission of plastic materials from the base, thereby increasing light output. Further, the metal outer shell of the subassembly will not discolor during use because of the effects of the operating temperature of the lamp.

Still further, it has been found that the thermally conductive metal shell of the subassembly not only equilibrates the heat so that the temperature of the entire lamp base is more uniform but lowers the maximum temperature on shell as well.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
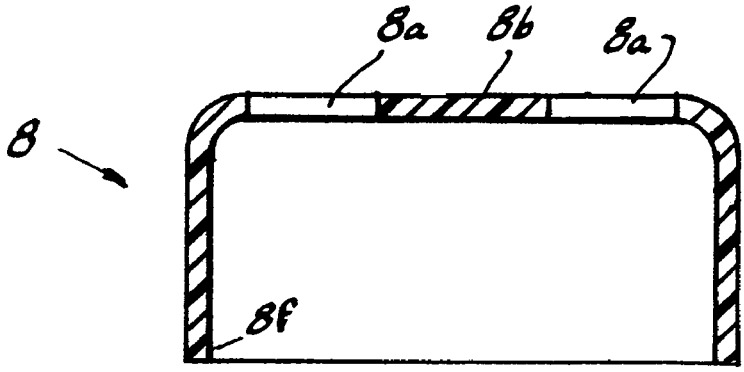
Fig. 1 Prior Art
FIG. 1 is a sectional view of a portion of a prior art outer shell.

Referring now to the drawings with greater particularity, there is shown in FIG. 1 a prior art shell or subassembly 8 for a compact fluorescent lamp. The shell 8 comprised a cup-shaped body of a plastic material, such as 30% glass fiber filled, polybutylene terephthalate (30% GFF, PBT). A plurality of lamp receiving apertures 8*a* were formed in an upper surface 8*b*, and the interior may accept the electronic ballast components (not shown), mounted upon a flange 8*d* whose peripheral edge 8*e* was sealed to the inner surface 8*f* of the shell 8 opposite the upper surface 8*b* (see FIG. 4). The problem with such construction appears after some extended use of a lamp in a fixture when the jointure between the flange of the base and the inner surface of shell would separate or crack. This condition is shown in FIG. 4 where the separation is enumerated as 8*c*.

Figure 2:
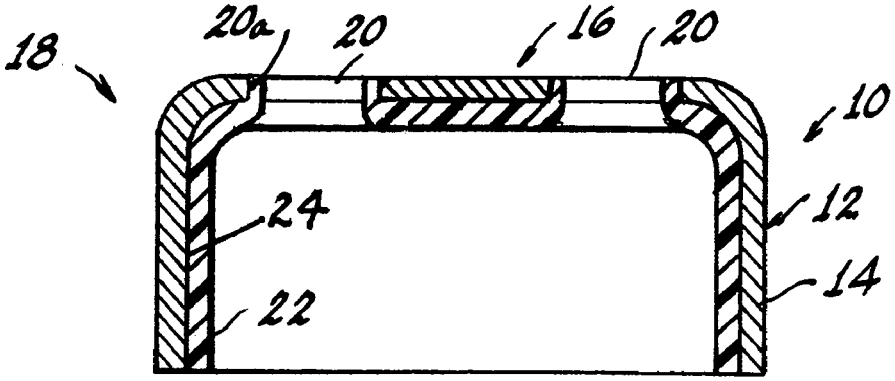
FIG. 2 is a similar view of an embodiment of the invention'
Figure 3:
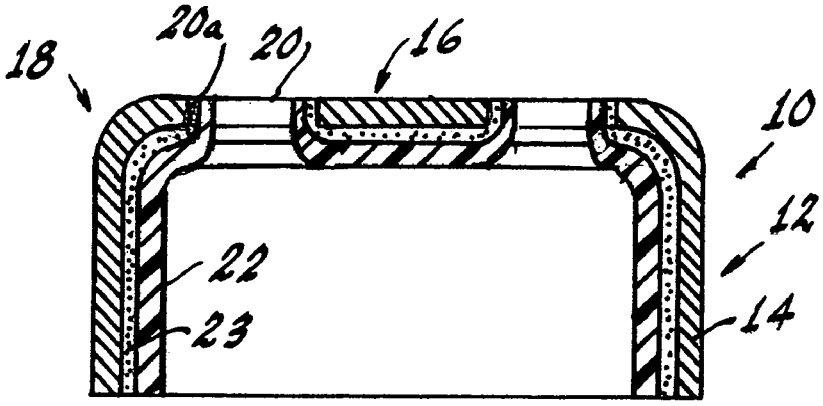
FIG. 3 is a similar view of an alternate embodiment of the invention.
Figure 5:
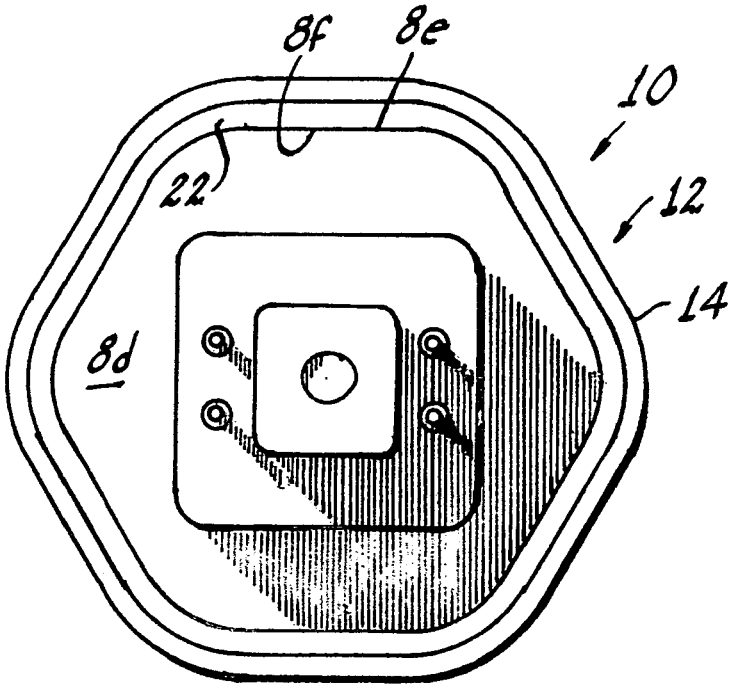
FIG. 5 is a similar view of a lamp base according to an aspect of the invention.

Referring now to FIGS. 2, 3 and 5, there is shown a subassembly 10 for a lamp base. The subassembly 10 comprises an outer housing 12 having a circumferential wall 14 and a top 16 closing one end 18 of said outer housing 12. At least one and preferably several lamp-receiving apertures 20 are formed in said top 16 and these openings have an edge 20*a*. An inner housing 22 is contiguous with the entire inside surface 24 of said outer housing 12, including the edges 20*a*. The outer housing 12 is a metallic material and the inner housing 22 comprises a plastic material. In a preferred embodiment of the invention the metallic material is aluminum and the plastic inner housing material is the before mentioned 30% GFF, PBT. Preferably, the receiving aperatures 20 have edges which are electrically insulated.

The plastic material of the inner housing 22 can be injection molded into outer housing 12 as shown in FIG. 2 or can be cemented or otherwise positioned with the outer housing 12 by the intermediary of a compound 23 as shown in FIG. 3 having good heat transfer capabilities. An example of a suitable product for compound 23 is sold under the tradename Loctite 384.

Figure 4:
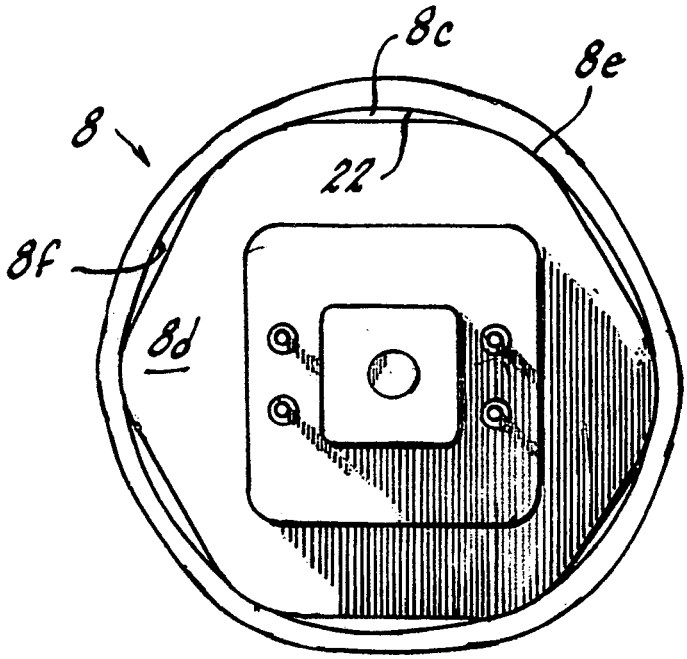
Fig. 4 Prior Art
FIG. 4 is a planar view of a prior art lamp base after extended heating.

FIGS. 4 and 5 are plan views of a prior art base and a base in accordance with an aspect of the invention after exposure to a high temperature (180° C.) for 2000 hours. While exaggerated here for illustration, the gap 8*c* that formed in the prior art structure is real and detrimental to the operation of the lamp and is a safety concern upon removal of the lamp from a live electrical socket.

The composite structure of the invention, i.e., the metal outer shell with the integral plastic lining showed no such effects, apparently because of the heat-sinking effect and structural rigidity of the metal shell. It has also been found that constructing the lamp base as described lowers the ignition voltage by up to 25 V. The metal outer shell also eliminates the emission of plastic material from the base, which would deposit on light reflective surfaces of the lighting fixture. The metal shell, therefore, improves lumen maintenance of the lighting system.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A subassembly for a base for a lamp, said subassembly comprising:

an outer housing having a circumferential wall and a top closing one end of said outer housing;

at least one lamp receiving aperture in said top; and an inner housing contiguous with the entire inside surface of said outer housing, said outer housing being a metallic material and said inner housing comprising a plastic material.

2. The subassembly of claim 1 wherein said top contains a plurality of lamp receiving apertures.

3. The subassembly of claim 1 wherein said metallic material is aluminum.

4. The subassembly of claim 1 wherein said plastic material is a resin.

5. The subassembly of claim 4 wherein said plastic material of said inner housing is injection molded into said outer housing.

6. The subassembly of claim 4 wherein said plastic material is cemented into said outer housing.

7. The subassembly of claim 2 wherein said plurality of lamp receiving apertures have edges and said edges are electrically insulated.

* * * * *